US006040828A

United States Patent [19]

Park

[11] Patent Number: 6,040,828

[45] Date of Patent: Mar. 21, 2000

[54] LIQUID CRYSTAL DISPLAY

[75] Inventor: Ki Pan Park, Seoul, Rep. of Korea

[73] Assignee: LG Electronics Inc., Seoul, Rep. of Korea

[21] Appl. No.: 08/856,576

[22] Filed: May 15, 1997

[30] Foreign Application Priority Data

May 15, 1996 [KR] Rep. of Korea ..... 96-16137

[51] Int. Cl.[7] ..... G09G 5/00

[52] U.S. Cl. ..... 345/213; 345/212

[58] Field of Search ..... 345/98, 99, 61, 345/208, 212, 213

[56] References Cited

U.S. PATENT DOCUMENTS

| | | | |
|---|---|---|---|
| 5,568,163 | 10/1996 | Okumura | 345/100 |
| 5,598,177 | 1/1997 | Mizukata et al. | 345/92 |
| 5,726,677 | 3/1998 | Imamura | 345/99 |
| 5,764,212 | 6/1998 | Nishitani et al. | 345/98 |
| 5,825,343 | 10/1998 | Moon | 345/94 |

*Primary Examiner*—Richard A. Hjerpe
*Assistant Examiner*—Henry N. Tran

[57] ABSTRACT

Disclosed is an improved gate line driver and method for a liquid crystal display. The method includes: receiving a horizontal synchronous Fh signal; and producing at least two non-overlapping gate line pulses during each period of the Fh signal. A first way to produce the gate line pulses is to: produce a gate shift clock GSC signal having a frequency f(GSC) at least twice as great as the frequency of the Fh signal f(Fh) such that f(GSC)≧f(Fh); and provide one gate line pulse during each period of the GSC signal. A second way to produce the gate line pulses is to: produce a gate shift clock GSC signal having a frequency f(GSC) the same as the frequency of the Fh signal f(Fh) such that f(GSC)=f(Fh); move a pulse through a plurality of shift registers according to the GSC signal; logically combine, e.g., by ANDing, the GSC signal and the sequence of shift register pulses to provide one of the gate line pulses during each period of the Fh signal; and logically combine, e.g., by ANDing, the inverted GSC signal and the sequence of shift register pulses to provide another one of the gate line pulses during each period of the Fh signal.

8 Claims, 7 Drawing Sheets

LIQUID CRYSTAL DISPLAY

FIELD OF THE INVENTION

The present invention relates to a liquid crystal display and, more particularly, to a liquid crystal display which is suitable for displaying a TV image signal of the NTSC system on a VGA class liquid crystal panel.

BACKGROUND OF THE INVENTION

In general, a speed-up device is employed in the conventional art for a liquid crystal panel having 480 data lines so as to display a video signal of an NTSC system having 240 data lines.

FIG. 1 is a block diagram showing the construction of a conventional liquid crystal display for displaying a video signal on a liquid crystal panel by using the speed-up device, and FIG. 2 is a detailed view showing the construction of the speed-up device as shown in FIG. 1.

A large-sized LCD module can exhibit a resolution at or above the VGA level, which is much greater than the 240 data lines per field for NTSC system video signals. Therefore, as shown in FIG. 1, the liquid crystal panel employs a speed-up device so as to display an image data on a TFT-LCD panel having 480 data lines.

In FIG. 2, the speed-up device of FIG. 1 comprises two line memories 1 and 2 and a memory controller 3. The memory controller 3 generates a control signal to process entered R, G and B signals at an increased speed. With this speed-up device, signals of 480 data lines are synchronously displayed on the LCD panel.

FIG. 3 is a timing diagram illustrating the operation of the conventional speed-up device. In FIG. 3, the whole 480 lines may be displayed on the LCD panel within the same time period required for the 240 lines of the NTSC signal by processing R, G, and B signals into R', G' and B' at an increased speed.

To display signals of 480 data lines without the above-described speed-up device, another method has been utilized where a gate driver IC is redesigned to synchronously generate gate driving pulses for two data lines. The signal-timing diagram in this case is shown in FIG. 4.

As shown in FIG. 4, two gates are opened at the same time by corresponding gate driving pulses, e.g., $G_1$ and $G_2$ for 1 horizontal synchronous interval. A horizontal synchronous interval refers to an interval between the generation of horizontal synchronous signals. It is also understood that the operating frequency of the horizontal synchronous signal is identical to that of the clock signal of the gate driver IC. It may be apparent that redesigning the gate driver IC as described above appears to be as effective as the employing a speed-up device for the purpose of displaying signals of 480 data lines on the LCD panel.

However, it is known that the conventional liquid crystal display presents the several problems. First, when a speed-up device is employed, the price of the system increases because the speed-up device requires a memory and a memory controller and too much noise may occur in the system due to the usage of the memory. Second, when a gate driver IC is redesigned, the development costs for a special gate driver IC are increased and the driving ability of a source driver IC must be improved because two picture elements are turned on by each output of the source driver IC.

SUMMARY OF THE INVENTION

Accordingly, the present invention is directed to a liquid crystal display that substantially obviates one or more of the problems due to limitations and disadvantages of the related art.

An object of the present invention is to provide an improved gate line driver and method for a liquid crystal display which employs special speed-up circuitry without requiring the memory of the conventional art so as to reduce the costs and noise of the system.

According to the present invention, the liquid crystal display can display TV type video signals on an LCD panel of VGA level without extending the driving abilities of a gate driver IC and a source driver IC because two gates or gate lines are driven in a non-overlapping manner during each horizontal synchronous interval. Further, the present invention can remarkably reduce the costs and noise of the system because it does not employ memory as in the conventional art.

These and other objects of the present invention are achieved by providing a liquid crystal display device, and method embodied thereby, comprising: a frequency division circuit for receiving a horizontal synchronous signal Fh and for providing a signal Fo/N and a signal Foh to said PLL, said Fo/N signal having a frequency equal to at least twice the frequency of said horizontal synchronous signal Fh, and said signal Foh having a frequency equal to approximately said signal Fh; and a gate driver circuit for receiving said signal Fo/N as a clock thereof and for producing at least two gate line pulses per one period of said signal Fh.

These and other objects of the present invention are also achieved by providing a gate driving device in a liquid crystal display, the device comprising: a plurality of shift registers for providing a driving signal to a plurality of gate lines according to a gate start pulse and a gate shift clock signal, respectively; and a plurality of first and second logic gate pairs at respective output terminals of said plurality of shift registers for producing two gate line pulses during each cycle of a horizontal synchronous signal; said first logic gates logically combining outputs of said shift registers and the gate shift clock signal, respectively, to produce one of said two gate line pulses during each horizontal synchronous signal; and said second logic gates logically combining an inverted signal of said gate shift clock signal and outputs of said shift registers, respectively, to produce the other of said two gate line pulses during each horizontal synchronous signal.

The foregoing and other objectives of the present invention will become more apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF PREFERRED EMBODIMENTS

Reference will now be made in detail to the preferred embodiments of the present invention, examples of which are illustrated in the accompanying drawings.

Figure 1:
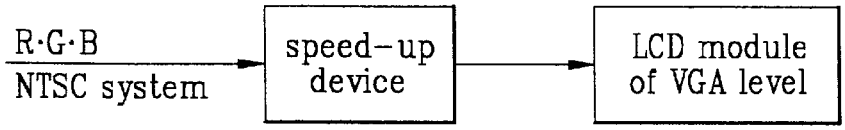
FIG.1 conventional art
FIG. 1 is a block diagram showing the construction of a conventional liquid crystal display.
Figure 2:
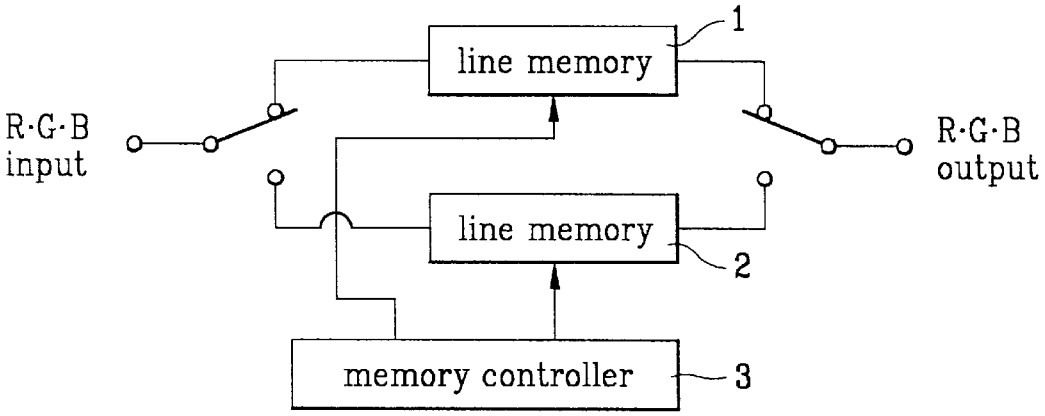
FIG.2 conventional art
FIG. 2 is a detailed view showing the construction of the speed-up device of FIG. 1.
Figure 3:
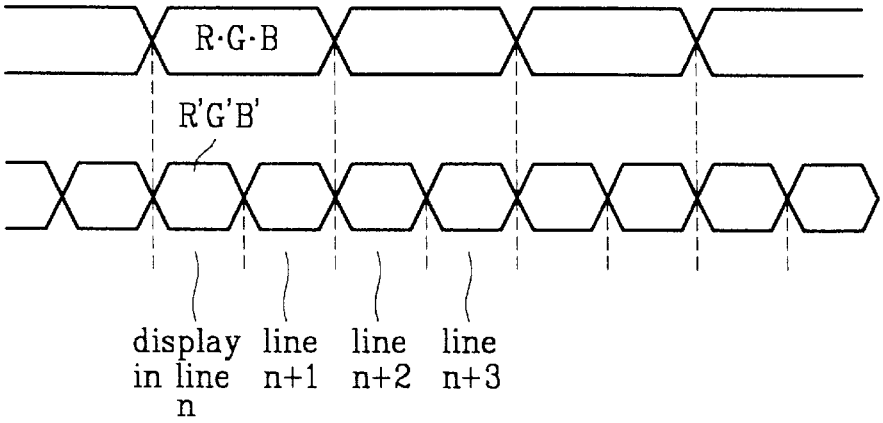
FIG.3 conventional art
FIG. 3 is a timing diagram illustrating the operation of the conventional speed-up device.
Figures 4A, 4B, 4C, 4D, 4E, 4F, 4G:
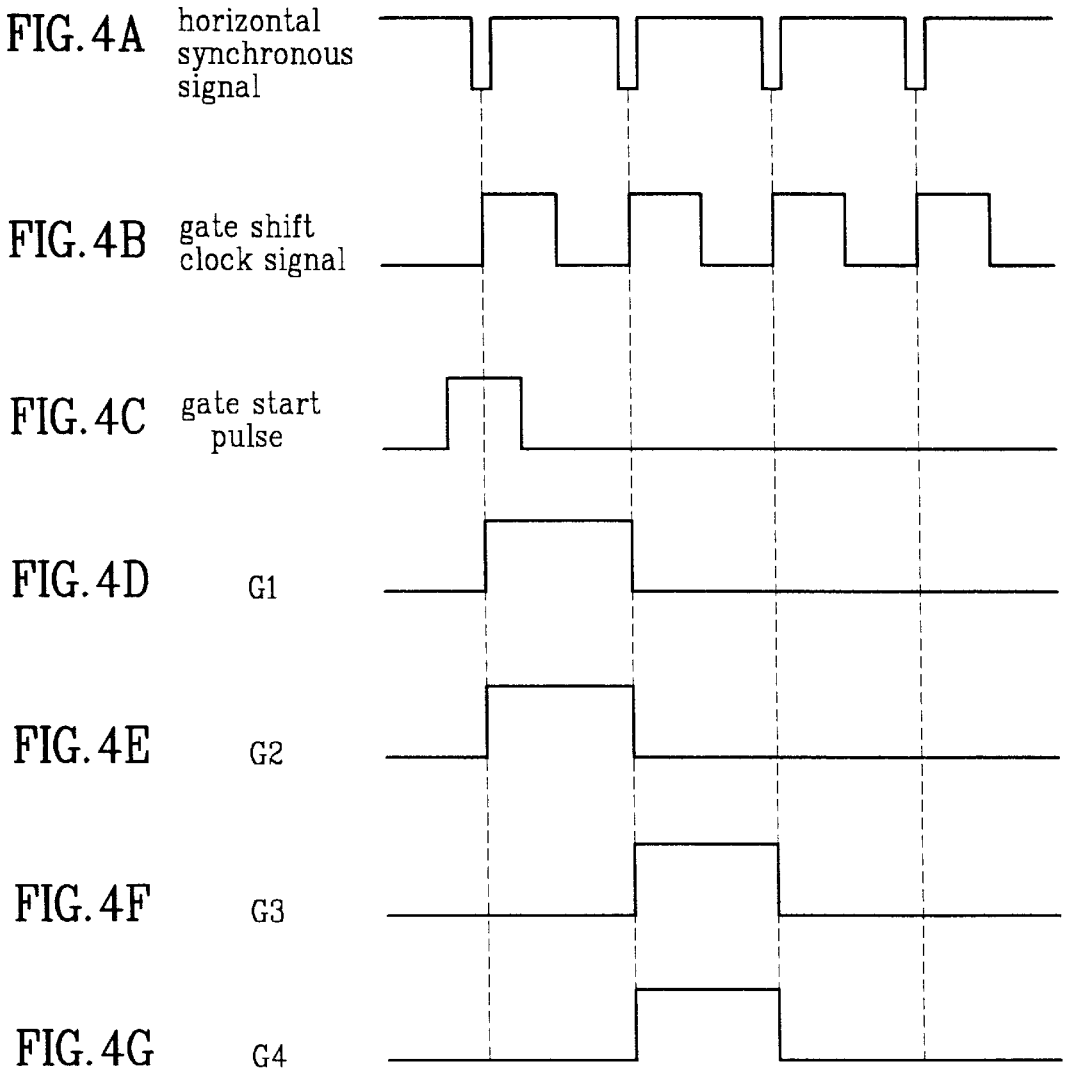
FIGS. 4A–4G conventional art
FIGS. 4A–4G are signal timing diagrams of a second conventional liquid crystal display.
Figure 5:
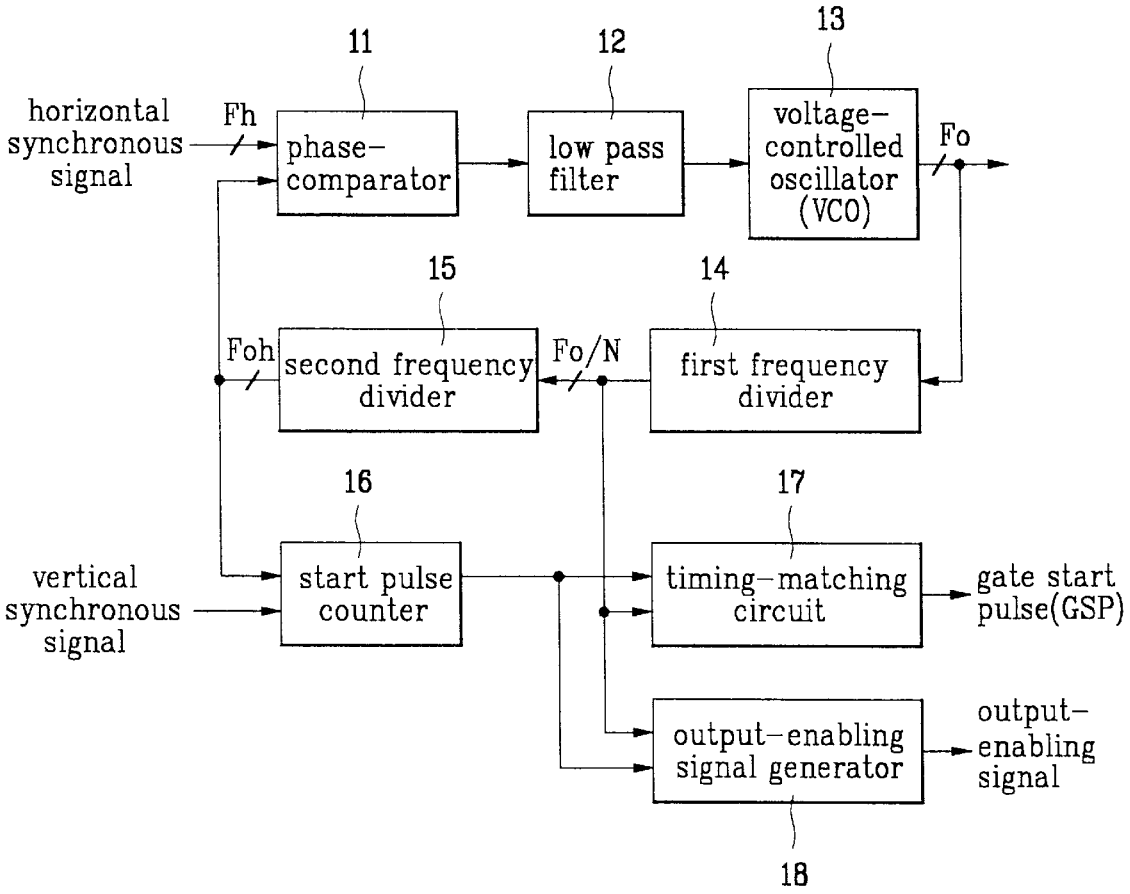
FIG. 5 is a block diagram showing the construction of the liquid crystal display according to a first embodiment of the present invention.

As shown in FIG. 5, the liquid crystal display according to a first embodiment of the present invention comprises a phase locked loop (PLL) phase-comparator circuit 11, a low pass filter 12, a voltage-controlled oscillator 13, a first frequency divider 14, a second frequency divider 15, a start pulse counter circuit 16, a timing-matching circuit 17 and an output enable signal generator 18.

The phase-comparator circuit 11 compares the phase of a horizontal synchronous signal, Fh, with the signal Foh, i.e., a version of an output signal (Fo) of the voltage-controlled oscillator 13 which is fed back through the first and second frequency dividers 14 and 15.

The low pass filter 12 transmits only low frequency signals among the output of the phase-comparator circuit 11 and substantially attenuates all other signals.

The voltage-controlled oscillator 13 receives the low frequency signal provided by the low pass filter 12 and converts it into the oscillating frequency of the signal, i.e., Fo. The output Fo of the oscillator 13 is much higher than Fh, e.g., Fo≈KFh, where K=1000. The frequency Fo depends upon the number of horizontal dots in the LCD module.

The first frequency divider 14 receives the output signal Fo of the voltage-controlled oscillator 13, converts it to a signal that is approximately double the horizontal synchronous signal required in the phase-comparator circuit 11, namely Fo/N≈2Fh and sends it to the second frequency divider 15 and the timing-matching circuit 17. Continuing with the example in which Fo≈KFh and KFh=1000 Fh, the output of the first divider 14 is $$Fo/N \approx \frac{KFh}{N} \approx 2Fh$$

where N=500.

The second frequency divider 15 receives the approximately doubled horizontal synchronous signal Fo/N and converts it into a signal Foh, approximately equal to the horizontal synchronous signal Fh, and supplies it to the phase-comparator circuit 11. To reiterate the first frequency divider 14 is an N divider and the second frequency divider 15 is 2 divider, where N is equal to K/2, N and K as positive integers, and K≧2.

Figure 9A:
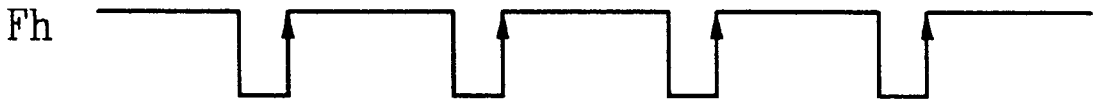
FIGS. 9A and 9B are waveforms depicting the relationship between the signals Fh and Foh according to the present invention.
Figure 9B:
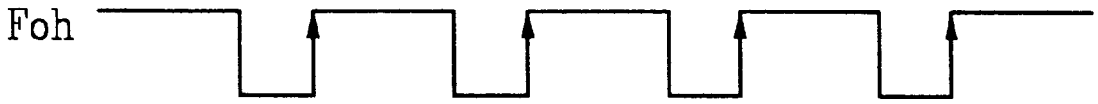

An example relationship between Fh and Foh is depicted in FIGS. 9A and 9B, respectively. FIGS. 9A and 9B reflect the preferred circumstance in which the first and second dividers 14 and 15 are triggered on the rising edges of the signals Fo and Fo/N, respectively. The frequencies of the signals Fo and Fo/N and the times at which their rising edges occur are the same, but the times at which their falling edges occur are different. Alternatively, if the first and second dividers 14 and 15 are triggered on the falling edges of the signals Fo and Fo/N, respectively, then the times at which the rising edges of the signals Fo and Fo/N occur will be different but their frequencies and the times at which their rising edges occur will be the same.

The start pulse counter circuit 16 receives the vertical synchronous signal and counts the number of approximated horizontal synchronous Foh signal cycles in a field. The counter is started by the vertical synchronous signal, i.e., this indicates the start point of a video signal or field. The output enabling signal generator 18 generates the signal that enables the data driver. The timing matching circuit 17 adjusts the start of the gate start pulse GSP so that a midpoint of the GSP will correspond to a rising edge of the gate shift clock GSC.

The timing-matching circuit 17 receives the approximately doubled horizontal synchronous signal Fo/N of the first frequency divider 14 and the output signal of the start pulse counter circuit 16, and produces a gate start pulse GSP that matches the timing of a gate shift clock GSC, where GSC corresponds to the signal Fo/N.

In other words, two clock signals GSC of a gate driver IC occur in a horizontal synchronous interval, and a GSC gate pulse is generated with each clock signal GSC of the gate driver IC. The gate start pulse has to occur so as to operate the gates.

The output enable signal generator 18 provides an output enable signal under the control of the output signal of the start pulse counter circuit 16 and the gate shift clock GSC signal. Again, the frequency of the gate shift clock GSC signal is approximately double that of the horizontal synchronous signal. i.e., it is the output of the first frequency divider 14. The gate shift clock signal GSC is, e.g., input as the clock of a plurality of shift registers in a gate driver IC (not shown) and this shift register starts shifting upon receiving the gate start pulse (GSP) signal. The outputs of the shift registers are used as the gate line pulses.

Figures 6A, 6B, 6C, 6D, 6E, 6F, 6G, 6H, 6I:
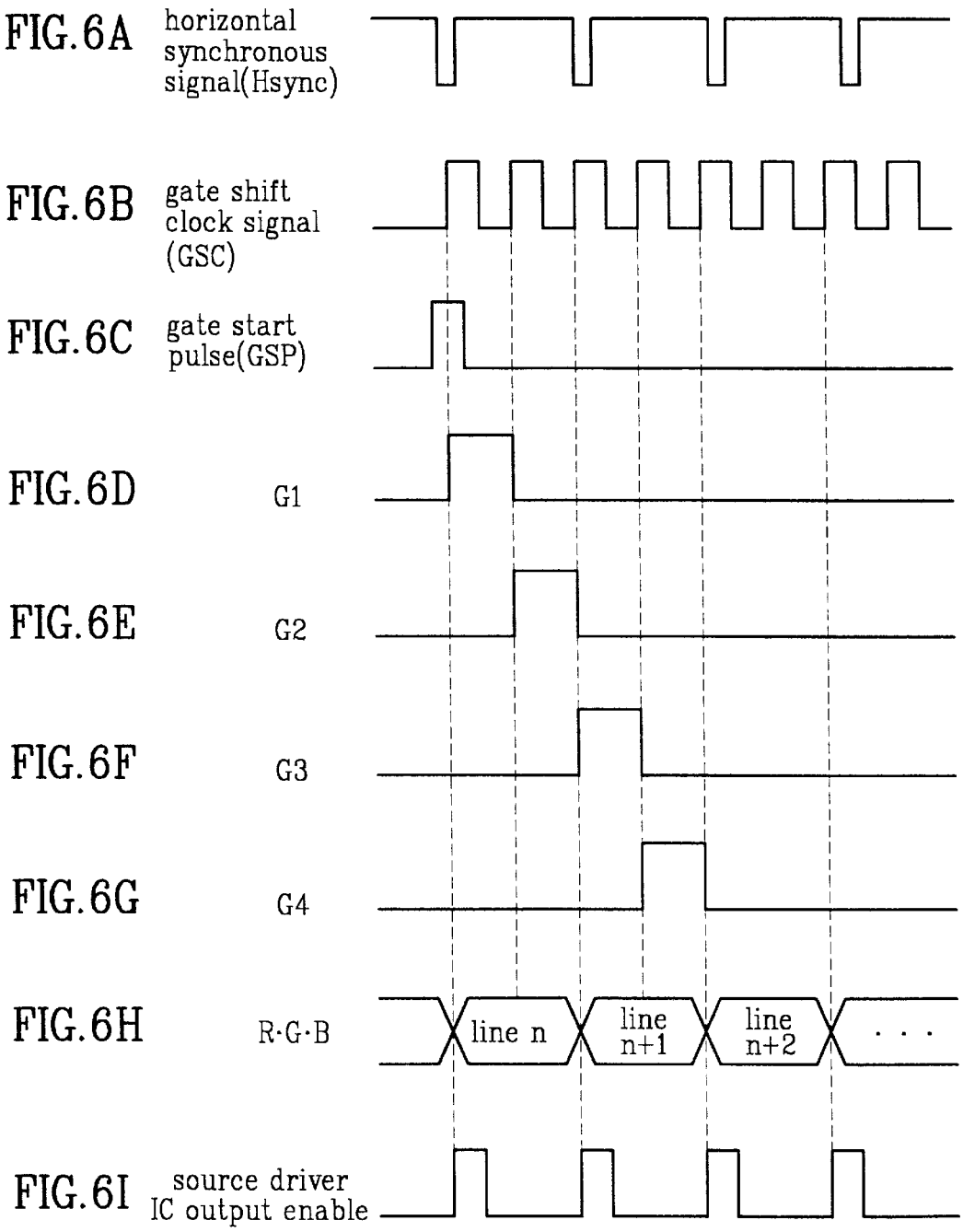
FIGS. 6A–6I are operational timing diagrams of the liquid crystal display depicted in FIG. 5 of the present invention.

FIG. 6 is an operational timing diagram of the liquid crystal display according to the first preferred embodiment of the present invention. In FIG. 6, the frequency of the gate shift clock GSC signal is double the frequency of the horizontal synchronous signal so as to provide two gate pulses per horizontal synchronous signal. In other words, when the horizontal synchronous interval is H, the gate shift clock signal occurs with a period of H/2.

Hence, e.g., the pulses $G_1$ and $G_2$ are produced in a sequential order according to the gate shift clock signal having a period of H/2. While the signal of the $n^{th}$ data line occurs, the pulses $G_1$ and $G_2$ of the gate driver IC are synchronously generated because a source driver IC is output-enabled with a period equal to the period of the horizontal synchronous signal, and therefore video data of 2 lines are driven in one horizontal synchronous interval.

Figure 7:
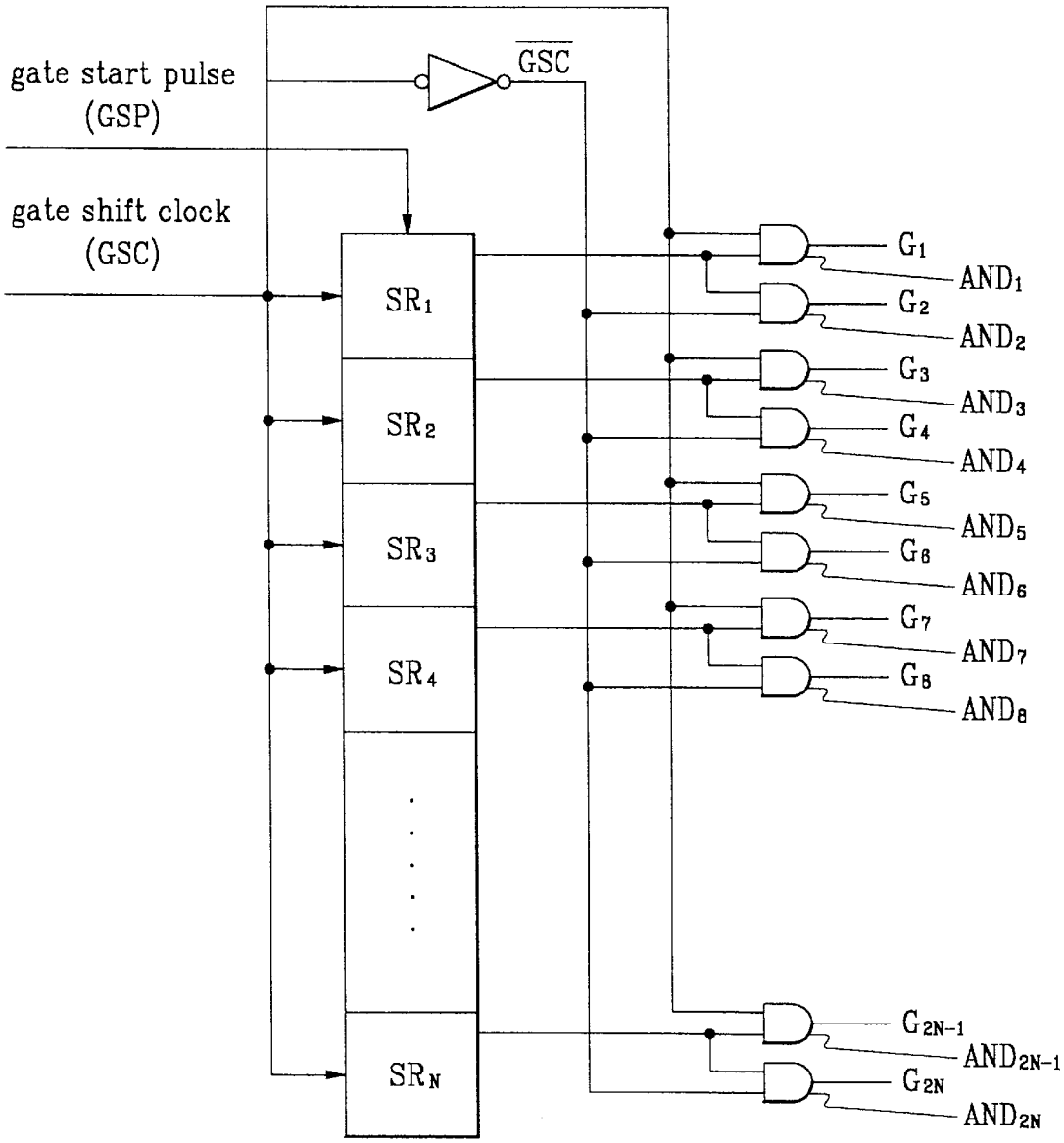
FIG. 7 is a circuit diagram of the gate driver IC according to the second embodiment of the present invention.

The liquid crystal display according to the second embodiment of the present invention is a modified gate driver IC which has shift registers (corresponding to shift registers used conventional LCDs) but also has special logic gates for the respective shift resistors so as to provide two gate pulses in one horizontal synchronous interval. As shown in FIG. 7, the gate driver IC according to the second embodiment of the present invention comprises a plurality of shift resistors $SR_1$ through $SR_N$ and a plurality of logic gates $AND_1$ through $AND_{2N}$. The gate shift clock (GSC) signal is input of the shift registers SR, through $SR_N$. The logic gates $AND_1$ through $AND_{2N}$ are AND gates and are alternatively applied with the gate shift clock GSC signal and with the inverted signal $\overline{GSC}$ of the gate shift clock GSC signal.

For example, the gate shift clock signal GSC is input to one input terminal of the $AND_1$ gate and the output signal of the shift register $SR_1$ is input to the other one to produce the gate line pulse $G_1$. Further, the output signal of the shift register $SR_1$ is input to one input terminal of the $AND_2$ gate and the inverted signal $\overline{GSC}$ of the gate shift clock signal is input to the other one to produce the gate line pulse $G_2$. The other gates $AND_3$ through $AND_{2N}$ are similarly connected.

Through the construction of the gate driver IC with a combination of the logic gates as described above, two gate start pulses occur in one horizontal synchronous interval.

Figures 8A, 8B, 8C, 8D, 8E, 8F, 8G, 8H, 8I, 8J, 8K:
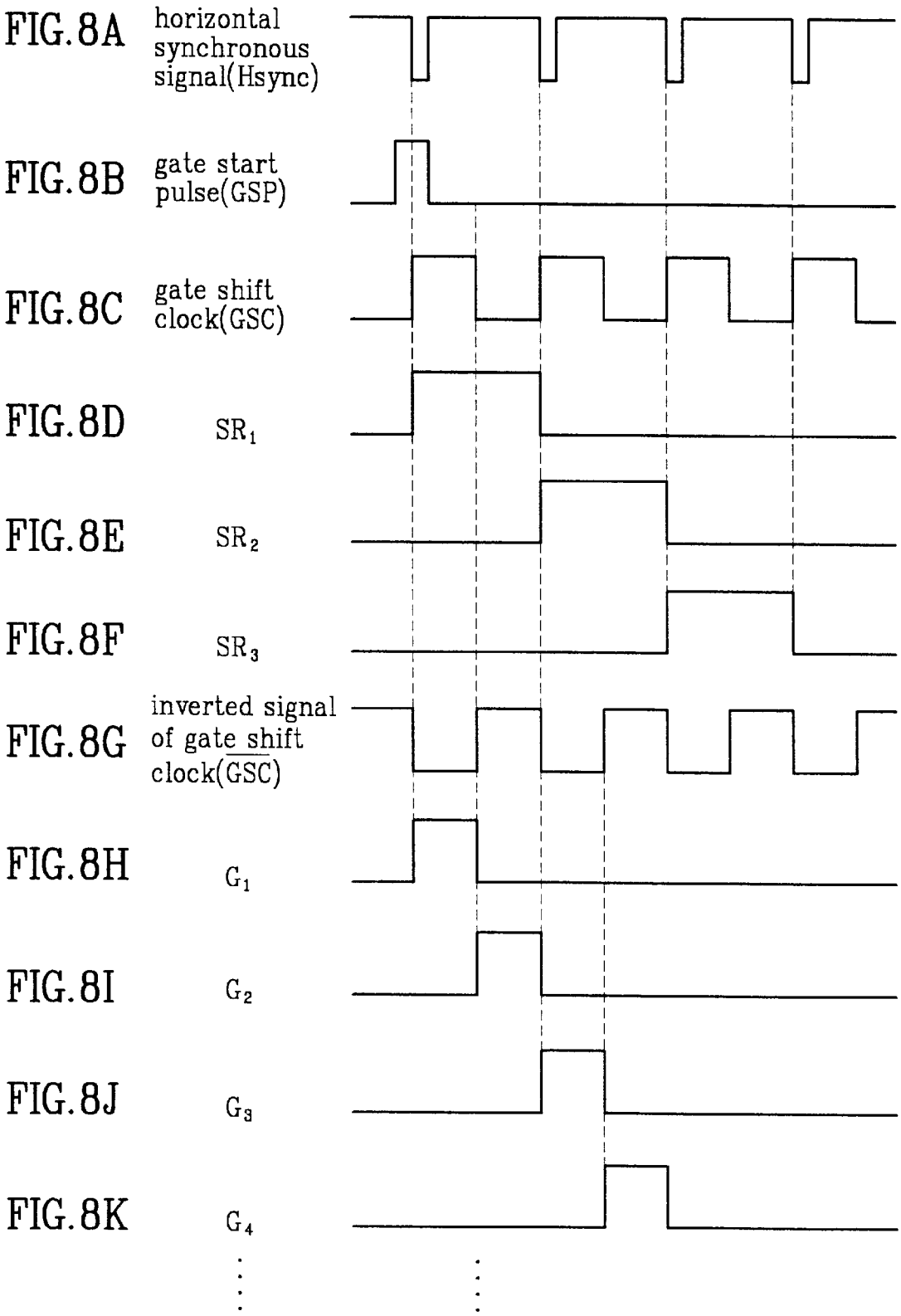
FIGS. 8A–8K are timing diagrams for the gate driver IC of FIG. 7.

FIG. 8 is a timing diagram for respective signals according to the second preferred embodiment of the present invention. The frequency of the horizontal synchronous signal is equal to that of the gate shift clock signal. Thus, the respective shift resistors are enabled in a sequential order whenever the gate shift clock signal occurs.

When the gate shift clock signal GSC and its inverted signal $\overline{GSC}$ are synchronously applied, the gate $G_1$ is driven during the positive trigger of the gate shift clock signal GSC, and the gate $G_2$ is driven during the positive trigger of the inverted signal $\overline{GSC}$ of the gate shift clock signal. Consequently, two corresponding gate pulses of the gate driver IC, e.g., $G_1$ and $G_2$, are sequentially enabled in a horizontal synchronous interval. Thus, the video data of two data lines can be driven.

It will be apparent to those skilled in the art that various modifications and variations can be made in the liquid crystal display of the present invention without departing from the spirit or scope of the invention. Thus, it is intended that the present invention cover the modifications and variations of this invention provided they come within the scope of the appended claims and their equivalents.

What is claimed is:

1. A liquid display device comprising:

a frequency division circuit for receiving a horizontal synchronous signal Fh and for providing a signal Fo/N and a signal Foh, said Fo/N signal having a frequency equal to at least twice the frequency of said horizontal synchronous signal Fh, and said signal Foh having a frequency equal to approximately said signal Fh; and a gate driver circuit for receiving said signal Fo/N as a clock thereof and for producing at least two gate line pulses per one period of said signal Fh.

2. The liquid crystal display as defined in claim 1, further comprising:

a counter circuit for counting said approximated horizontal synchronous signal Foh so as to indicate the start point of a video signal;

a timing-matching circuit for receiving the output of the counter circuit and said signal Fo/N, and for providing a start pulse according thereto, respectively; and an output enable signal generator for receiving said output of the counter circuit and said signal Fo/N and providing an output enable signal.

3. The liquid crystal display as defined in claim 1, wherein said frequency division circuit comprises:

a first frequency divider for receiving said signal Fo/N and for providing said signal Fo/N; and a second frequency divider for receiving said signal Fo/N and for providing said signal Foh.

4. The liquid crystal display as defined in claim 3, wherein said frequency division circuit further comprises:

a voltage-controlled oscillator for producing a signal Fo; and a phase-locked loop (PLL) for detecting a phase difference between said signal Fo of said voltage-controlled oscillator and that of a horizontal synchronous signal Fh and for providing said phase difference at least indirectly to said voltage-controlled oscillator.

5. A gate driving device in a liquid crystal display, the device comprising:

a plurality of shift registers for providing a driving signal to a plurality of gate lines according to a gate start pulse and a gate shift clock signal, respectively; and a plurality of first and second logic gate pairs at respective output terminals of said plurality of shift registers for producing two gate line pulses during each cycle of a horizontal synchronous signal;

said first logic gates being for logically combining outputs of said shift registers and a gate shift clock signal, respectively, to produce one of said two gate line pulses during each horizontal synchronous signal; and said second logic being for logically combining an inverted signal of said gate shift clock signal and outputs of said shift registers, respectively, to produce the other of said two gate line pulses during each horizontal synchronous signal.

6. The liquid crystal display as defined in claim 5, wherein said first and second logic gates are AND gates.

7. A method for producing gate line pulses in a liquid crystal display, the method comprising the steps of:

receiving a horizontal synchronous Fh signal;

producing a gate shift clock GSC signal having a frequency f(GSC) the same as the frequency of said Fh signal f(Fh) such that f(GSC)=f(Fh);

moving a pulse through a plurality of shift registers according to said GSC signal to produce a sequence of shift register pulses;

logically combining said GSC signal and said sequence of shift register pulses to provide one of said at least two non-overlapping gate line pulses during each period of said Fh signal;

inverting said GSC signal; and logically combining the inverted GSC signal and said sequence of shift register pulses to provide another one of said at least two non-overlapping gate line pulses during each period of said Fh signal.

8. The method of claim 7, wherein:

said step of logically combining said GSC signal and said sequence of shift register pulses includes logically ANDing said GSC signal and said sequence of shift register pulses; and said step of logically combining said inverted GSC signal and said sequence of shift register pulses includes logically ANDing said inverted GSC signal and said sequence of shift register pulses.

* * * * *